US006880507B2

(12) United States Patent
Kuhl et al.

(10) Patent No.: US 6,880,507 B2
(45) Date of Patent: Apr. 19, 2005

(54) INTERNAL COMBUSTION ENGINE WITH SWITCHABLE CAM FOLLOWER

(75) Inventors: Mario Kuhl, Herzogenaurach (DE); Henning Karbstein, Strullendorf (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/794,112

(22) Filed: Mar. 5, 2004

(65) Prior Publication Data

US 2004/0187823 A1 Sep. 30, 2004

(30) Foreign Application Priority Data

Mar. 5, 2003 (DE) ..... 103 09 408

(51) Int. Cl.[7] ..... F01L 1/14

(52) U.S. Cl. ..... 123/90.52; 123/90.55; 123/90.48; 123/90.2; 123/198 F

(58) Field of Search ..... 123/90.48, 90.52–90.55, 123/90.58, 90.59, 90.2, 90.16, 90.31, 90.15, 198 F

(56) References Cited

U.S. PATENT DOCUMENTS

| | | | | | |
|---|---|---|---|---|---|
| 2,325,932 | A | * | 8/1943 | Banker | 123/90.59 |
| 2,821,970 | A | * | 2/1958 | Line | 123/90.55 |
| 2,938,508 | A | * | 5/1960 | Papenguth | 123/90.59 |
| 4,541,374 | A | | 9/1985 | Kodama | |
| 5,975,038 | A | * | 11/1999 | Fischer et al. | 123/90.55 |
| 6,497,207 | B1 | * | 12/2002 | Spath et al. | 123/90.16 |
| 2002/0046718 | A1 | | 4/2002 | Spath et al. | |

FOREIGN PATENT DOCUMENTS

| | | |
|---|---|---|
| DE | 196 03 916.9 | 7/1997 |
| DE | 101 19 366.1 | 10/2002 |
| WO | 98/36161 | 2/1997 |

* cited by examiner

*Primary Examiner*—Thomas Denion
*Assistant Examiner*—Kyle M. Riddle
(74) *Attorney, Agent, or Firm*—Volpe and Koenig, P.C.

(57) ABSTRACT

An internal combustion engine having a valve train that includes a switchable cam follower is provided. The cam follower (20) has a generally cylindrical shape and can move longitudinally in a receptacle (21) of the engine (22), and is acted upon at one axial end by a cam (23) of a camshaft and at the other axial end indirectly or directly by a gas exchange valve of the valve train. A main oil gallery (24) is arranged in the internal combustion engine (22) for introducing hydraulic medium to a valve lash adjustment element arranged in the cam follower (20). A switchable oil channel (25) is arranged in the internal combustion engine (22) for introducing hydraulic medium into a region of a switch element arranged in the cam follower (20), wherein, the outer surface of the cam follower (20) has a helical groove (26), through which at a peripheral point of the cam follower (20) the switchable oil channel (25) is connected hydraulically to the region of the switch element which opens at another peripheral point of the cam follower (20).

1 Claim, 2 Drawing Sheets

INTERNAL COMBUSTION ENGINE WITH SWITCHABLE CAM FOLLOWER

FIELD OF THE INVENTION

The invention relates to an internal combustion engine, whose valve train includes switchable cam followers, with each cam follower featuring an essentially circular cylindrical shape and being guided so that it can move longitudinally in a receptacle of the engine, so that a force is applied at one axial end by a cam of a camshaft and at the other axial end indirectly or directly by a gas exchange valve of the valve train, with a main oil gallery arranged in the internal combustion engine for introducing hydraulic medium into a valve lash adjustment element arranged in the cam follower and with a switchable oil channel arranged in the internal combustion engine for introducing hydraulic medium into the region of a switch element arranged in the cam follower.

BACKGROUND

In an internal combustion engine known from DE 198 44 202 A1 (which corresponds to U.S. Pat. No. 6,164,255), the valve train component is formed as a switchable, circular cylindrical cam follower, which is arranged so that it can move longitudinally in a receptacle configured as a bore hole and which can be moved at one longitudinal end by the cam of a camshaft against the force of the valve spring of a gas exchange valve.

The cam follower contains a hydraulic valve lash adjustment element, which requires oil as a hydraulic medium in order to fulfill its function of lash adjustment. Consequently, in the internal combustion engine a main gallery is arranged as an oil supply line to the valve lash adjustment element.

The switchable cam follower is provided with a switch element. When the camshaft rotates and the cam acts on the follower, the switch element allows the gas exchange valve to open periodically in one switch position and in the other switch position, the transfer of forces from the cam to the gas exchange valve are stopped, so that this valve remains constantly in the closed position. For the activation of the switch element, the cam follower also requires oil as hydraulic medium, which is supplied to the cam follower from a switchable oil bore in the internal combustion engine.

For dual flow oil supply to switchable valve train components according to the conventional state of the art, a first oil supply supplies the hydraulic valve lash adjustment. This oil also has a lubricating function. A second oil supply takes over the regulating function of a switch element formed as a coupling mechanism. In most cases, this dual flow supply is realized over the cylinder casing of the cam follower, which can be, e.g., a bucket tappet, a roller tappet, or a bearing element.

Disadvantages in these known valve train components are that there are additional costs due to modified engine constructions and thus associated complicated component constructions. Complicated component constructions can also be encumbered with functional disadvantages due to greater masses and throttling problems.

SUMMARY

The invention provides a switchable roller tappet, which is suitable for certain engine constructions, for which the position of the main oil gallery and the switchable oil bore hole are fixed in advance. However, a completely new construction of the roller tappet for adapting to these engine conditions should be avoided because on one hand this would rely on the same strategy and on the other hand this would be considerably more complex and thus more expensive, more difficult, and more susceptible to risks. Elimination of the dual flow oil supply is not considered, because a common oil supply for the main oil gallery and the switchable oil bore for low oil pressures would limit functionality and lower function reliability.

According to the invention, the outer surface of the cam follower has a helical groove, through which at a peripheral point of the cam follower the switchable oil channel is connected hydraulically to the region of the switch element opened at another peripheral point of the cam follower.

According to another aspect of the invention, the outer surface of the cam follower has a helical groove, through which at a peripheral point of the cam follower the main oil gallery is connected hydraulically to an inlet opening located at another peripheral point of the cam follower for the valve lash adjustment element. Also, two helical grooves can be arranged on one cam follower.

Through a helical groove, which is arranged on the outer surface of a circular cylindrical cam follower of a valve train, the oil flow from the switchable oil channel and the oil flow from the main oil gallery in the direction of motion of the cam follower or along its height axis, can be interchanged outside of the cam follower, more precisely between the cam follower and its guidance in a receptacle of an internal combustion engine. This is necessary, especially when a certain angular position of the oil inlet in the cam follower is advantageous. It can be necessary, e.g., in order to guarantee protection against leakage for the receptacle of the valve lash adjustment element when the engine is idling, or for achieving a "stiff" oil column, to maintain a ventilation capability for the switchable oil channel directed upwards away from the cam follower.

Two helical grooves on the casing of the cam follower achieves the following advantages: the existing main oil gallery, which is arranged parallel to the axes of the camshaft and the crankshaft, can be kept. The switchable oil channel can be configured as a simple bore hole extending directly from the center of the engine in the radial direction to the cam follower. Through the switchable oil helical groove, there is a unique oil path directed downwards to the cam follower or a unique oil path directed upwards and thus good ventilation behavior. Thus, the cam follower can be designed so that in a structurally simply way, the valve lash adjustment element is arranged above and the switch mechanism lies below. Thus, in a simple way the invention can be used equally for similarly built engines with, however, different oil supplies. In addition, the lubricating behavior of the cam follower guidance is improved.

BRIEF DESCRIPTION OF THE DRAWINGS

A preferred embodiment of the invention is shown in the drawings and is described in more detail in the following in comparison with an internal combustion engine according to previously known state of the art. In the drawings.

DETAILED DESCRIPTION OF THE PREFERRED EMBODIMENTS

Figure 2:
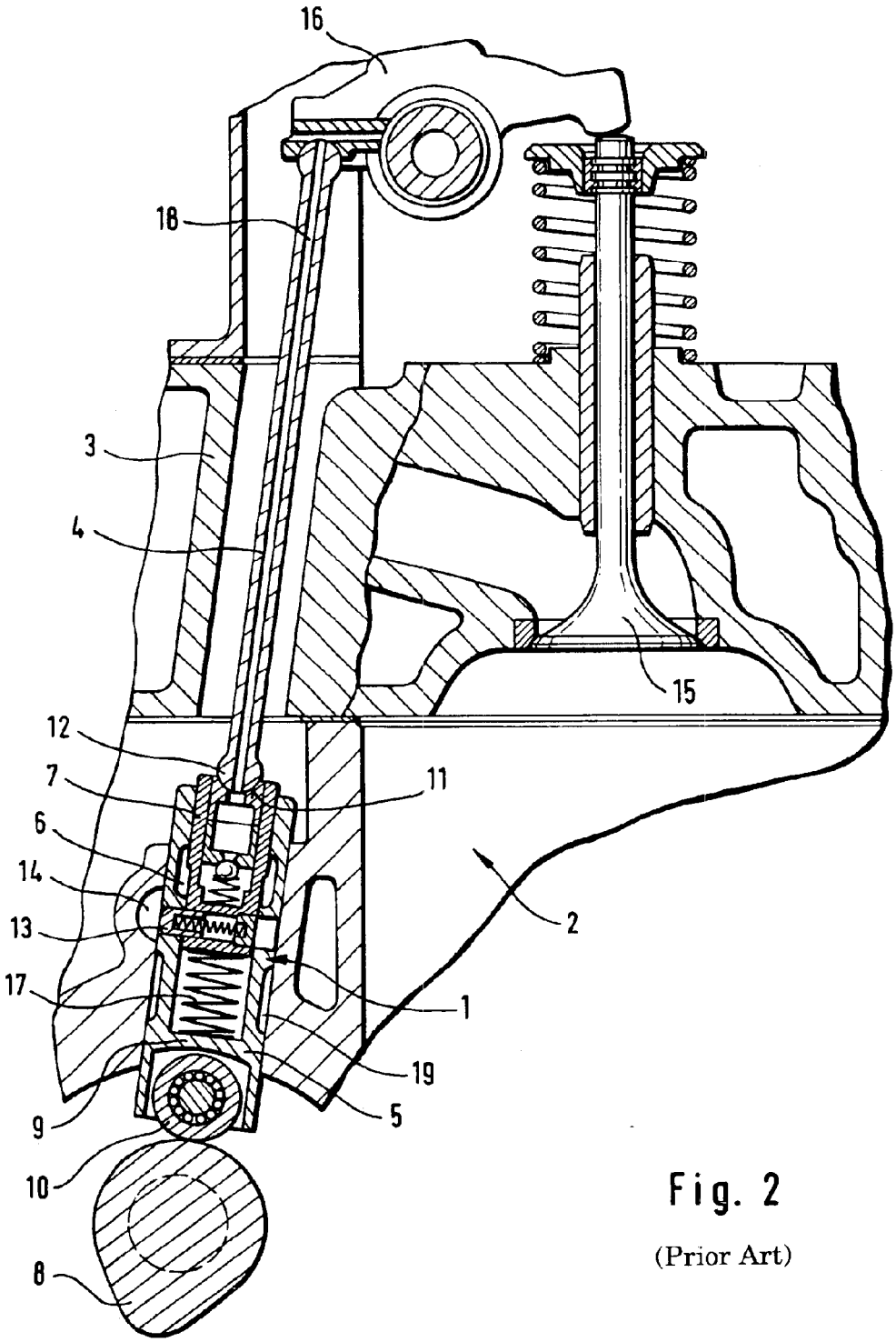
Fig. 2 (Prior Art)
FIG. 2 is a cross-sectional vies of a previously known internal combustion engine with an inserted cam follower.

The switchable cam follower 1 shown in FIG. 2 according to the previously known state of the art is installed in a valve train 2 of an internal combustion engine, and acts upon push rods 4. The cam follower 1 includes an outer cylindrical section 5, which encloses in its interior 6 an inner cylindrical section 7. The section 7 can move in the axial direction relative to the section 5.

The outer section 5 faces with one end a cam 8 of a camshaft and is closed by a base 9. In the region of the base 9 there is a roller 10, whose outer surface is used as a contact surface for the cam 8. The roller 10 is supported on a rolling support on a pin, which is guided in the region of the base 9 diametrically through the outer section 5 and is fixed there with its ends by crimping in the outer section 5.

With its end located outside of the outer section 5, the inner section 7 faces the push rod 4, which is here supported on a dome-shaped contact surface 11 of the inner section 7 with its end 12. Here, the contact surface 11 is part of a lash adjustment element, which is formed, among other things, by the inner section 7.

Hydraulic medium can be led to an outer end of a switch element 13 actuating the switching process of the cam follower 1. For this purpose, a channel 14 is provided in the internal combustion engine 3. To achieve a large lift of a gas exchange valve 15, which is connected over a valve lifter 16 and the tappet push rods to the valve train 2, coupling is required between the outer section 5 with the inner section 7 of the cam follower 1. The switch element 13 is produced as a piston-like slider, which is held in the coupling position by a compression spring.

If shut-off of the gas exchange valve 15 is desired, then hydraulic pressure is guided from the channel 14 in front of the outer end of the switch element 13. If the cam follower 1 is located in its base cycle phase, in which the outer section 5 and the inner section 7 are not tensioned against each other, then upon sufficient pressure of the hydraulic medium, the switch element 13 is displaced against the force of its compression spring in the radial direction completely into the inner section 7. For the subsequent cam stroke, the outer section 5 is then shifted relative to the inner section 7 against the force of a compression spring 17 arranged in the outer section 5. The push rods 4 and the gas exchange valve 15 are not displaced, because the force of the compression spring 17 of the outer section 5 is smaller than the opposing force of the compression spring of the gas exchange valve 15.

The lash adjustment element, which is formed, among other things, by the inner cylindrical section 7 and which is arranged in this section, requires as a hydraulically operating lash adjustment element the supply of oil as hydraulic medium. For this purpose, a supply line 18 is arranged in the push rod 4. However, instead of this supply line, a hydraulic medium supply line, which leads in the internal combustion engine 3 into the receptacle 19 for the outer cylindrical section 5, is also possible.

Figure 1:
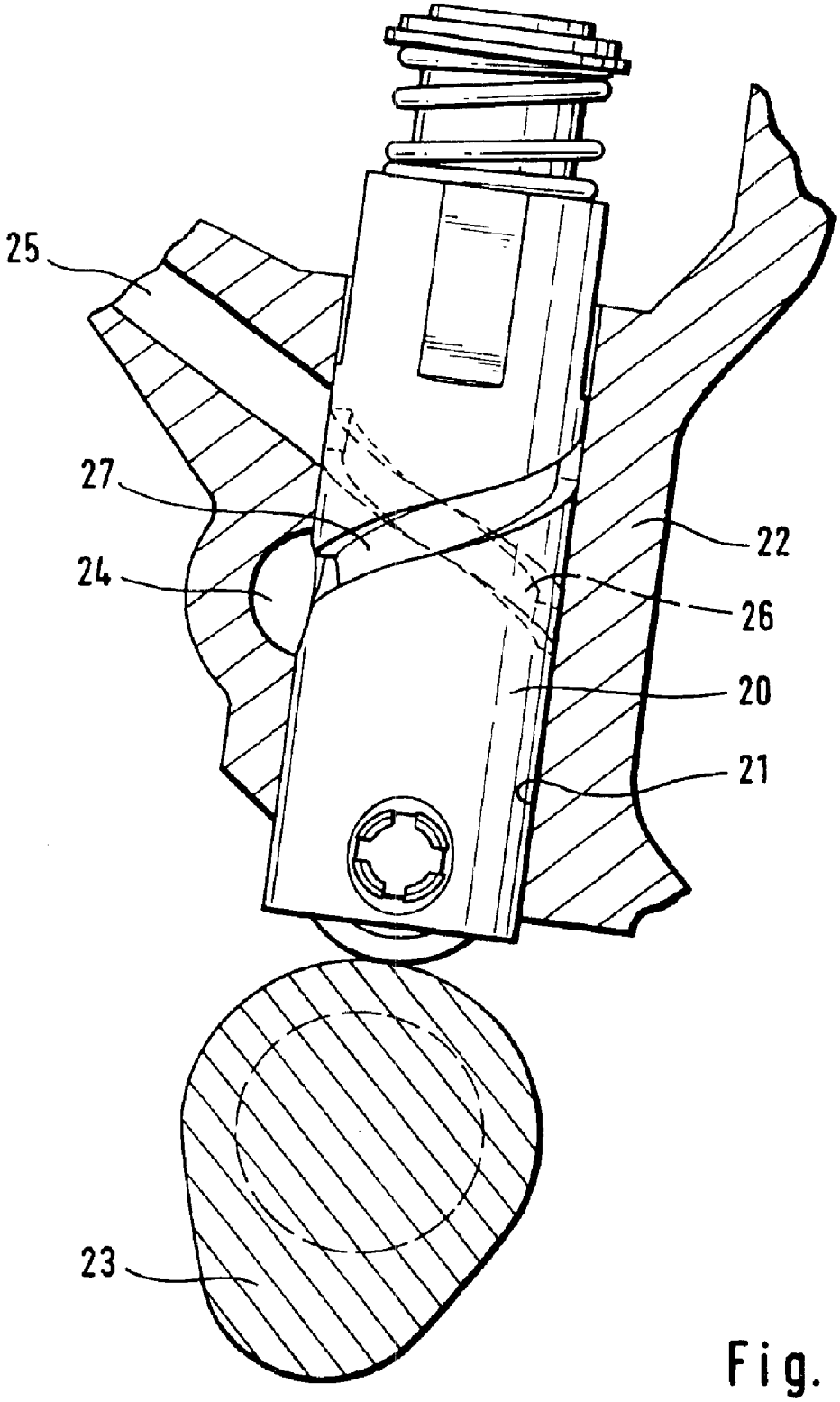
FIG. 1 is a side view of a cam follower according to the invention, which is located in an internal combustion engine shown in cross section.

The cam follower 20 shown in FIG. 1 according to the invention is an essentially circular cylindrical component, which is inserted into a receptacle 21 of an internal combustion engine 22 and which can move longitudinally in this receptacle. At its lower axial end, the cam follower 20 is acted upon by the cam 23 of a camshaft of the internal combustion engine 22. At its upper axial end, the cam follower 20 is connected directly or indirectly to a gas exchange valve of the internal combustion engine 22. In the cam follower 20, there is a hydraulic valve lash adjustment element, which receives its hydraulic means from a main oil gallery 24 of the internal combustion engine 22. In addition, in the cam follower 20, as, e.g., in the previously known state of the art, a switch element is provided, which receives the hydraulic means required for performing the switching process from a switchable oil channel 25 of the internal combustion engine 22. This is arranged above the main oil gallery 24.

In the cam follower 20, the valve lash adjustment element is arranged in the upper region facing the gas exchange valve. The switch element is located underneath for turning on or turning off the axial force, which is to be transferred to the gas exchange valve. So that hydraulic medium can be guided from the higher lying switchable oil channel 25 in the internal combustion engine 22 into the lower lying region of the switch element in the cam follower 20, according to the invention a helical groove 26 running downwards is machined into the cam follower 20, which starts from the outer surface of the cam follower 20 located within the receptacle 21 of the internal combustion engine 22.

In a corresponding way, according to the invention another groove 27, which, however, extends upwards, is machined into the cam follower 20, which enables hydraulic means to be guided from the lower lying main oil gallery 24 in the internal combustion engine 22 into the higher lying valve lash adjustment element in the cam follower 20.

Instead of the helical grooves 26 and 27, which are machined into the casing surface of the cam follower 20, it is also possible to provide a collection of sunken surfaces, which are offset in the radial direction and which are arranged one behind the other in the shape of a helix.

LIST OF REFERENCE SYMBOLS

1 Cam follower
2 Valve train
3 Internal combustion engine
4 Tappet push rod
5 Outer cylindrical section
6 Interior
7 Inner cylindrical section
8 Cam
9 Base
10 Roller
11 Contact surface
12 End of the tappet push rod
13 Switch element
14 Channel
15 Gas exchange valve
16 Valve lifter
17 Compression spring
18 Supply line
19 Receptacle
20 Cam follower
21 Receptacle
22 Internal combustion engine
23 Cam
24 Main oil gallery
25 Switchable oil channel
26 Groove
27 Groove

What is claimed is:

1. Internal combustion engine comprising a valve train that includes a switchable cam follower having a generally cylindrical shape and moveable longitudinally in a receptacle of the engine, the cam follower is acted upon at one axial end by a cam of a camshaft and at an other axial end indirectly or directly by a gas exchange valve of the valve train, a main oil gallery is arranged in the internal combustion engine for introducing hydraulic medium into a valve lash adjustment element arranged in the cam follower, and a switchable oil channel is arranged in the internal combustion engine for introducing hydraulic medium into a region of a switch element arranged in the cam follower, wherein the cam follower includes two non-intersecting helical grooves, a first helical groove being located on an outer surface of the cam follower, through which at a first peripheral point of the cam follower the switchable oil channel is connected hydraulically to a region of an inlet opening for a switch element at second peripheral point of the cam follower, and a second helical groove on the outer surface of the cam follower, through which at a third peripheral point of the cam follower the main oil gallery is hydraulically connected to an inlet opening of the valve lash adjustment element located at a fourth peripheral point of the cam follower.

* * * * *